US008466940B2

(12) United States Patent
Kawaguchi et al.

(10) Patent No.: US 8,466,940 B2
(45) Date of Patent: Jun. 18, 2013

(54) RECORDING MEDIUM REMOVING APPARATUS, ERASING APPARATUS, CUTTING APPARATUS, AND RECORDING MEDIUM REMOVING METHOD

(75) Inventors: Takahiro Kawaguchi, Shizuoka (JP); Isao Yahata, Shizuoka (JP); Ken Iguchi, Shizuoka (JP); Hiroyuki Taguchi, Shizuoka (JP); Hiroyuki Tsuchihashi, Shizuoka (JP); Hiroyuki Taki, Shizuoka (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 296 days.

(21) Appl. No.: 13/038,215

(22) Filed: Mar. 1, 2011

(65) Prior Publication Data

US 2011/0221850 A1 Sep. 15, 2011

Related U.S. Application Data

(60) Provisional application No. 61/314,102, filed on Mar. 15, 2010, provisional application No. 61/314,105, filed on Mar. 15, 2010.

(51) Int. Cl.
*B65H 7/02* (2006.01)
*B41J 2/315* (2006.01)

(52) U.S. Cl.
USPC ..... 347/179

(58) Field of Classification Search
USPC ..... 347/171, 179; 400/120.01, 695, 400/699
See application file for complete search history.

(56) References Cited

U.S. PATENT DOCUMENTS

2010/0321457 A1* 12/2010 Kawaguchi et al. ..... 347/179
2011/0033216 A1* 2/2011 Taki et al. ..... 399/341
2011/0074901 A1* 3/2011 Tsuchihashi et al. ..... 347/179

OTHER PUBLICATIONS

U.S. Appl. No. 13/038,188, filed Mar. 1, 2011.

* cited by examiner

*Primary Examiner* — Huan Tran
(74) *Attorney, Agent, or Firm* — Patterson & Sheridan, LLP

(57) ABSTRACT

According to one embodiment, an erasing apparatus including a recording medium removing apparatus includes: a thickness sensor configured to change an output signal according to the thickness of a recording medium; a recording medium conveying mechanism configured to convey the recording medium; a recording medium removing mechanism provided downstream in a recording medium conveying direction of the thickness sensor and configured to remove the recording medium in a direction perpendicular to the recording medium conveying direction; a control unit configured to remove, if the control unit determines that the recording medium is unconveyable, the recording medium from a recording medium conveying path with the recording medium removing mechanism; and a heating roller configured to heat the recording medium to temperature equal to or higher than erasing temperature.

20 Claims, 9 Drawing Sheets

RECORDING MEDIUM REMOVING APPARATUS, ERASING APPARATUS, CUTTING APPARATUS, AND RECORDING MEDIUM REMOVING METHOD

CROSS-REFERENCE TO RELATED APPLICATIONS

This application is based upon and claims the benefit of priority from the prior the U.S. Patent Application No. 61/314,102, filed on Mar. 15, 2010, and the prior the U.S. Patent Application No. 61/314,105, filed on Mar. 15, 2010, and the entire contents of which are incorporated herein by reference.

FIELD

Embodiments described herein relate generally to a recording medium removing apparatus, an erasing apparatus, a cutting apparatus, and a recording medium removing method.

BACKGROUND

For saving of resources, in some case, image formation is performed using erasable developing materials. As the erasable developing materials, there are toner, ink, and the like erased by heat. Recording media on which images are formed with such erasable developing materials are reused after being heated by an erasing apparatus to have the images erased from the recording media.

However, recording media inserted into the erasing apparatus are not always separated one by one. For example, in some case, a stapled sheet bundle, a pasted and bound sheet bundle, or the like is inserted.

If such a sheet bundle is conveyed, not only a jam occurs but also the erasing apparatus is damaged.

Concerning this problem, there is proposed a technique for setting a double feed sensor and a thickness sensor in a recording medium conveying path and, if plural recording media are simultaneously conveyed, discarding the recording media in a disposal box.

However, if a sheet bundle having thickness equal to or larger than a measurement tolerance of the thickness sensor is conveyed, not only a jam occurs but also a mechanism section is damaged.

Therefore, there is a demand for a recording medium removing apparatus that can remove a sheet bundle having thickness exceeding the tolerance of the thickness sensor when the sheet bundle is conveyed thereto, an erasing apparatus and a cutting apparatus including the recording medium removing apparatus, and a recording medium removing method for use in the recording medium removing apparatus.

DETAILED DESCRIPTION

Throughout this description, the embodiments and examples shown should be considered as exemplars, rather than limitations on the apparatus and methods of the present embodiments.

Exemplary embodiments of a recording medium removing apparatus, an erasing apparatus, a cutting apparatus and a recording medium removing method of the present invention are explained in detail below with reference to the accompanying drawings.

In general, according to one embodiment, a recording medium removing apparatus includes: a thickness sensor configured to change an output signal according to the thickness of a recording medium; a recording medium conveying mechanism configured to convey the recording medium; a recording medium removing mechanism provided downstream in a recording medium conveying direction of the thickness sensor and configured to remove the recording medium sideways with respect to the recording medium conveying direction; and a control unit configured to remove, if the control unit determines that the recording medium is unconveyable, the recording medium from a recording medium conveying path with the recording medium removing mechanism.

According to another embodiment, an erasing apparatus includes: a thickness sensor configured to change an output signal according to the thickness of a recording medium; a recording medium conveying mechanism configured to convey the recording medium; a recording medium removing mechanism provided downstream in a recording medium conveying direction of the thickness sensor and configured to remove the recording medium sideways with respect to the recording medium conveying direction; a control unit configured to remove, if the control unit determines that the recording medium is unconveyable, the recording medium from a recording medium conveying path with the recording medium removing mechanism; and a heating roller configured to heat the recording medium to temperature equal to or higher than erasing temperature.

First Embodiment

Figure 1:
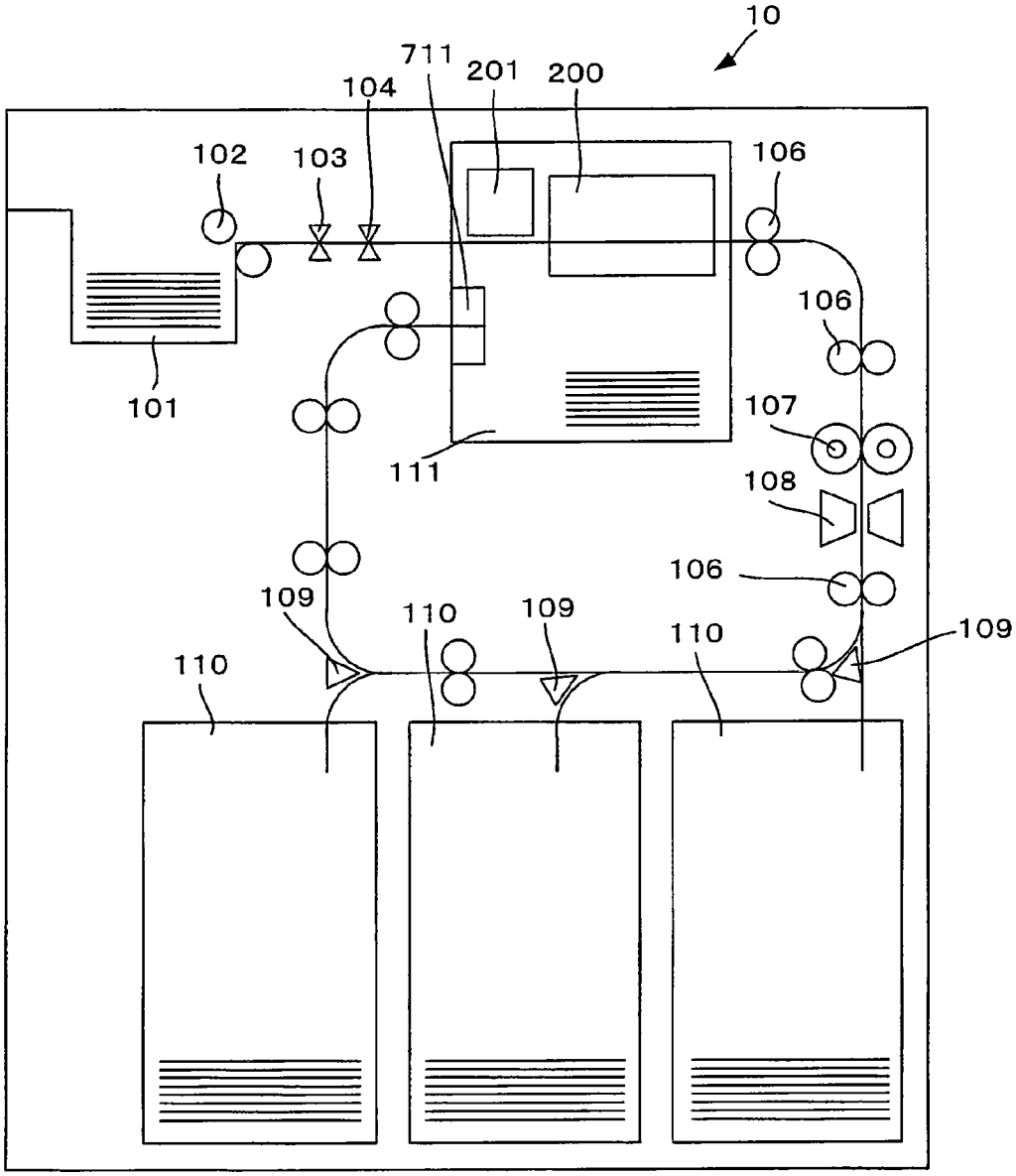
FIG. 1 is a side view of an erasing apparatus including a recording medium removing apparatus according to a first embodiment.

FIG. 1 is a side view of an erasing apparatus 10 including a recording medium removing apparatus 200 according to a first embodiment. As shown in FIG. 1, the erasing apparatus 10 includes an inlet tray 101 on which recording media to be subjected to erasing are placed, a pickup roller 102 configured to pick up the recording media placed on the inlet tray 101 one by one, an inlet sensor 103 configured to detect passage of the recording medium, a double feed sensor 104 configured to detect double feed of the recording media, conveying rollers 106 configured to convey the recording medium, a recording medium removing apparatus 200 configured to remove, from a recording medium conveying path, the recording medium determined as unconveyable, a thickness sensor 201 configured to detect the thickness of the recording medium, a heating roller 107, as the heating device, configured to heat the recording medium to temperature equal to or higher than erasing temperature, an image detection sensor 108 configured to detect whether an image on the recording medium is erased, switching devices 109 configured to switch a conveying path for the recording medium, reuse boxes 110 in which reusable recording media are accumulated, a disposal box 111 in which unreusable recording media are accumulated, and a control unit.

The double feed sensor 104 causes, for example, ultrasound to pass from one surface to the other surface of the recording medium and outputs a level of the ultrasound passed through the recording medium. The control unit determines double feed on the basis of the level.

The heating roller 107, as the heating device, is formed of metal and includes a heater on the inside thereof. The heating roller 107 heats an erasable developing material on the recording medium to temperature equal to or higher than the erasing temperature and subjects the recording medium to erasing.

Any heat source may be used for the heating device as long as the devices can heat the recording media to the color erasing temperature or higher. For the heating devices, for example, thermal heads, halogen heaters, graphite heaters, IH (Induction Heater), rollers formed by heat conducting materials with heat generating lamps inside, or the like may be employed.

Any heat source which heats the recording media without contacting also may be employed for the heating device.

Examples of the erasable developing material include a color-assuming compound, a developer, and a decolorizer. Examples of the color-assuming compound include a leuco dye. Examples of the developer include phenol. Examples of the decolorizer include a substance that, when heated, dissolves with the color-assuming compound and does not have affinity with the developer.

The erasable developing material develops a color according to a mutual action of the color-assuming compound and the developer. Since the mutual action of the color-assuming compound and the developer is interrupted by heating to temperature equal to or higher than the erasing temperature, the developing material is erased.

The recording medium is determined as unreusable if an un-erased image is present on the recording medium. The recording medium is conveyed through the recording medium conveying path switched by the switching devices 109 and accumulated in the disposal box 111.

The recording medium removing apparatus 200 is set upstream in the recording medium conveying direction of the heating roller 107. The recording medium removing apparatus 200 is set further upstream in the recording medium conveying direction than a first curved portion of the recording medium conveying path.

The erasing apparatus 10 includes the thickness sensor 201 further upstream in the recording medium conveying direction than the recording medium removing apparatus 200. The thickness sensor 201 brings an actuator into contact with the recording medium, transmits the movement of the actuator to a permanent magnet, detects the movement of the permanent magnet with a magnetic sensor, and outputs a signal corresponding to the thickness of the recording medium. The control unit determines the thickness of the recording medium on the basis of the output signal.

The recording medium removing apparatus 200 includes the disposal box 111 below the recording medium removing apparatus 200.

The recording medium removing apparatus 200 conveys the recording medium determined as unconveyable on the basis of the output of the thickness sensor 201 in a direction perpendicular to the recording medium conveying direction and removes the recording medium from the recording medium conveying path. The control unit determines that the recording medium is unconveyable if the output of the thickness sensor 201 is equal to or larger than a threshold.

The erasing apparatus 10 may include, at a terminal end of the recording medium conveying path leading to the disposal box 111, a shredder mechanism 711 configured to cut a paper-like member. When a shredder inlet sensor is turned on, the shredder mechanism 711 rotates a shredder cutter. The erasing apparatus 10 inserts the recording medium determined as unreusable after an erasing operation into the shredder mechanism 711 and shreds the recording medium.

Figure 2:
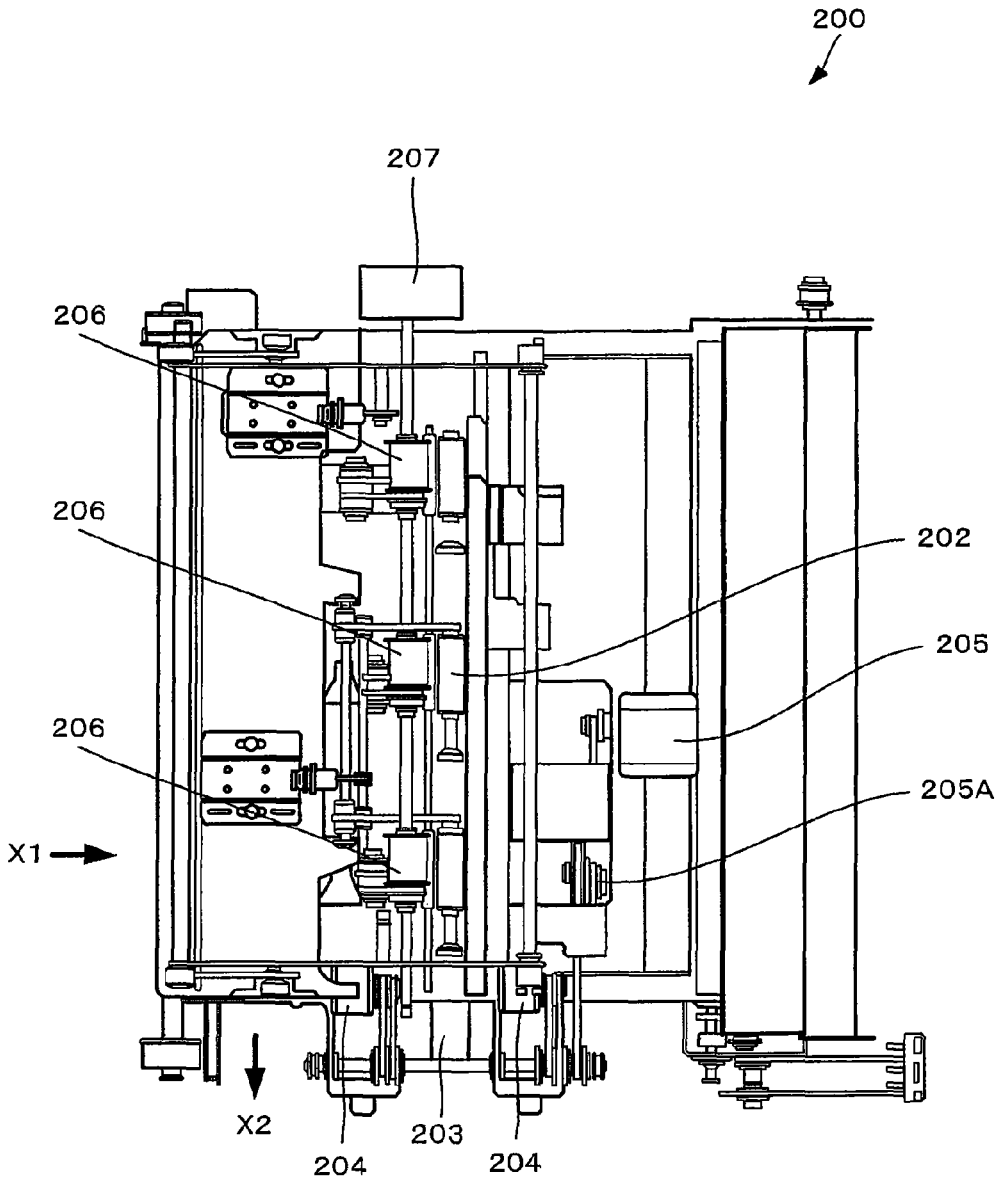
FIG. 2 is a plan view of the recording medium removing apparatus according to the first embodiment.

FIG. 2 is a plan view of the recording medium removing apparatus 200. As shown in FIG. 2, the recording medium removing apparatus 200 includes, as a recording medium removing mechanism, conveying rollers 206 configured to convey the recording medium in the recording medium conveying direction, a conveying motor 207 configured to drive the conveying rollers 206, passage sensors 202 configured to detect that the recording medium reaches a removing position, discharge rollers 204 configured to remove the recording medium from the recording medium conveying path, a discharge sensor 203 configured to detect whether the recording medium is present in a discharge position, a discharge motor 205 configured to drive the discharge rollers 204 and displace the conveying rollers 206, and a clutch 205A configured to switch a transmission direction of driving force of the discharge motor 205.

The recording medium removing apparatus 200 includes the discharge rollers 204 with a rotation axis thereof set in parallel to an arrow X1 direction, which is the recording medium conveying direction. The recording medium removing apparatus 200 removes the recording medium unconveyable by the discharge rollers 204 sideways with respect to the recording medium conveying direction, for example, an arrow X2 direction, which is the direction perpendicular to the recording medium conveying direction.

Figure 3:
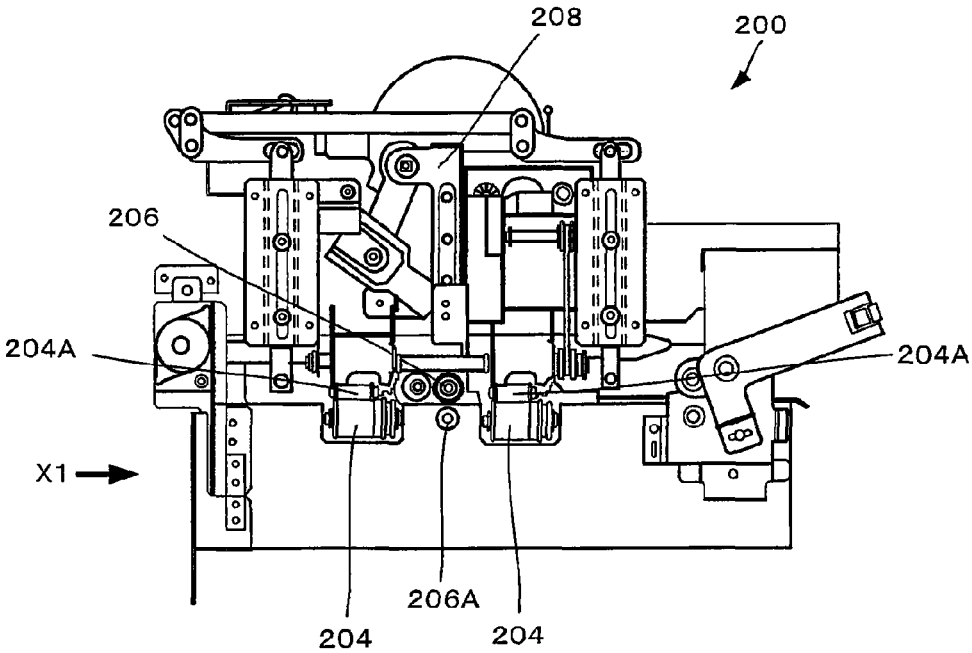
FIG. 3 is a front view of the recording medium removing apparatus according to the first embodiment viewed from a recording medium removing direction.

FIG. 3 is a front view of the recording medium removing apparatus 200 viewed from the recording medium removing direction. As shown in FIG. 3, the conveying rollers 206 form pairs with lower conveying rollers 206A, nip the recording medium in cooperation with the lower conveying rollers 206A, and rotate to thereby convey the recording medium. The recording medium removing mechanism 200 includes a displacing mechanism 208 configured to displace the conveying rollers 206 upward.

Figure 4:
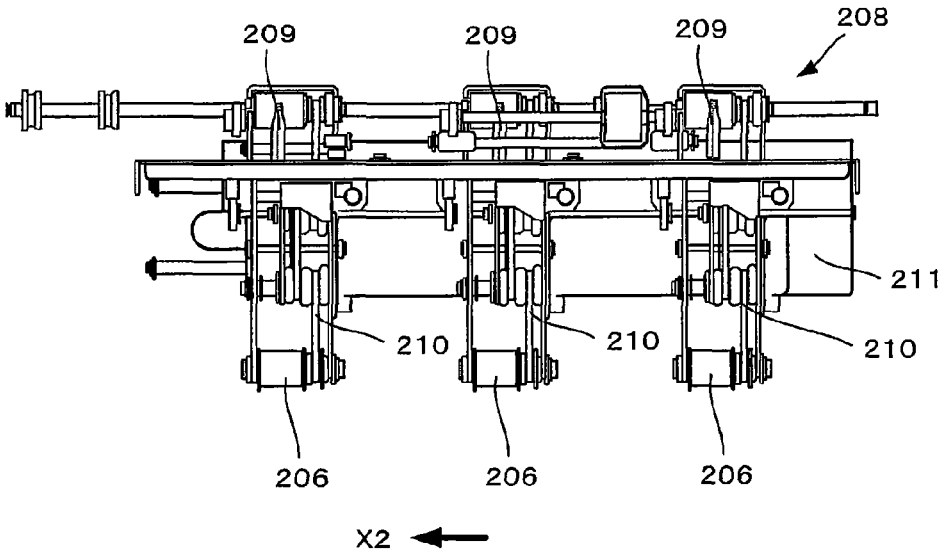
FIG. 4 is a side view of the recording medium removing apparatus according to the first embodiment viewed from downstream in a recording medium conveying direction of a conveying roller.

FIG. 4 is a side view of the conveying rollers 206 viewed from downstream in the recording medium conveying direction. As shown in FIG. 4, the displacing mechanism 208 includes conveying roller solenoids 209 configured to displace the conveying rollers 206 and roller belts 210 configured to drive the conveying rollers 206.

The recording medium removing apparatus 200 includes a frame 211 configured to support the conveying rollers 206 and the lower conveying rollers 206A. If the discharge motor 205 is driven in a state in which the clutch 205A is connected, the frame 211 is displaced in the arrow X2 direction, which is a direction in which the recording medium is removed.

The erasing apparatus 10 conveys the recording medium in the arrow X1 direction, which is the recording medium conveying direction. If the control unit determines, on the basis of the output of the thickness sensor 201, that the recording medium being conveyed is an unconveyable recording medium, the erasing apparatus 10 stops the conveying motor 207 at timing when the passage sensors 202 detect the recording medium.

In a state in which the conveying rollers 206 nip the recording medium in cooperation with the lower conveying rollers 206A, the erasing apparatus 10 connects the clutch 205A and drives the discharge motor 205.

Driving force of the discharge motor 205 displaces the frame 211, which supports the conveying rollers 206 and the lower conveying rollers 206A, in the X2 direction, which is the direction perpendicular to the recording medium conveying direction.

If the frame 211 displaces the conveying rollers 206 and the lower conveying rollers 206A in the arrow X2 direction, the discharge sensor 203 detects the recording medium.

If the discharge sensor 203 detects the recording medium, the erasing apparatus 10 drives the displacing mechanism 208 and displaces the conveying rollers 206 upward. If the conveying rollers 206 are displaced upward, the nipped recording medium is released.

The erasing apparatus 10 releases the clutch 205A and rotates the discharge motor 205. In a state in which the clutch 205A is released, driving force of the discharge motor 205 rotates the discharge rollers 204.

Therefore, the recording medium is removed in the X2 direction by the discharge rollers 204.

Figure 5:
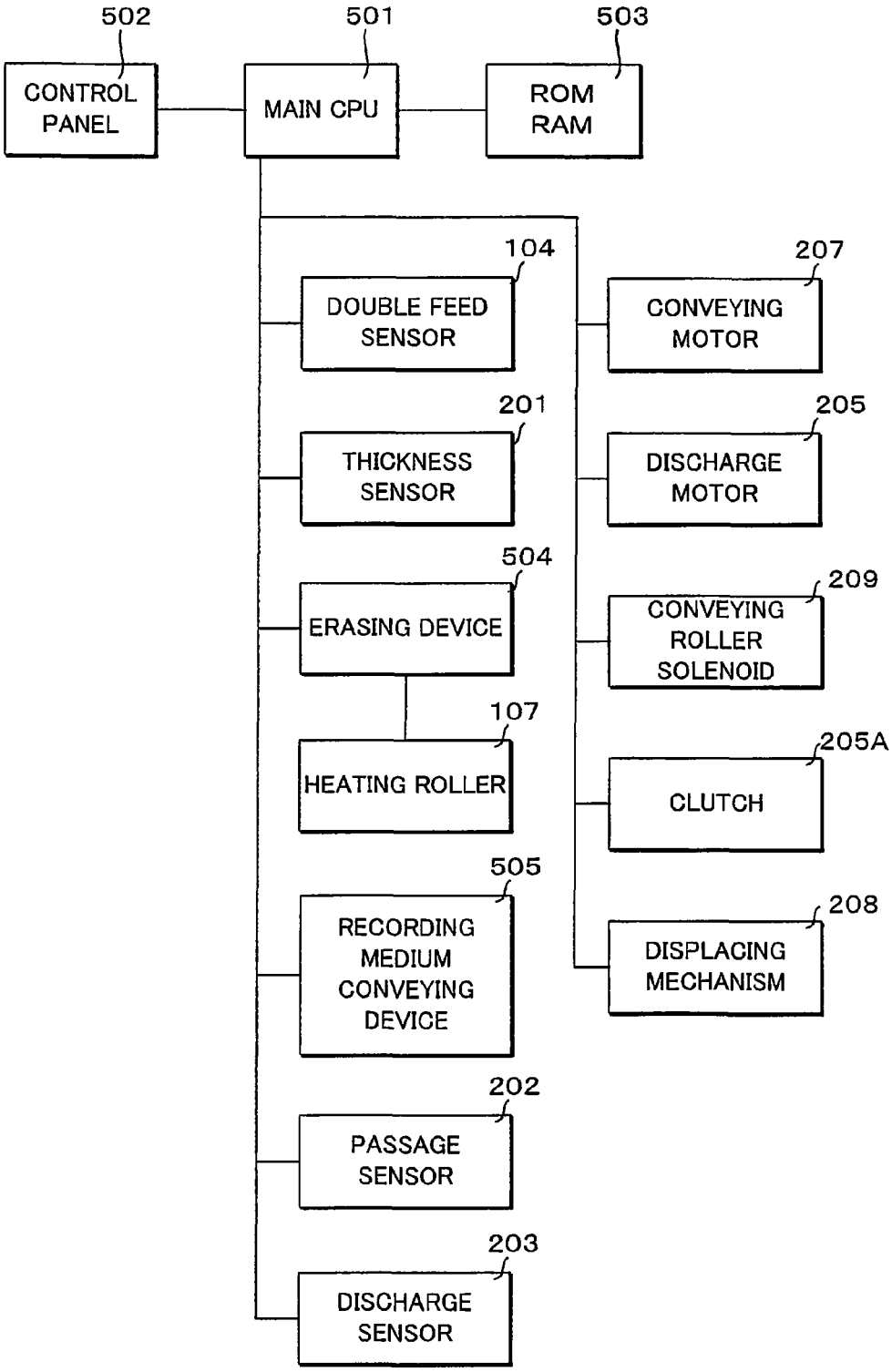
FIG. 5 is a block diagram of the configuration of the erasing apparatus according to the first embodiment.

FIG. 5 is a block diagram of the configuration of the erasing apparatus 10. As shown in FIG. 5, the erasing apparatus 10 includes a main CPU 501 serving as a control unit, a control panel 502 serving as a display device, and a ROM and RAM 503 serving as a storage device.

The main CPU 501 is connected to the double feed sensor 104, the thickness sensor 201, the passage sensors 202 provided in positions corresponding to the conveying rollers 206 in the recording medium conveying path of the recording medium removing apparatus 200 and configured to detect that the recording medium reaches a dischargeable position, and the discharge sensor 203, all of which are included in the erasing apparatus 10. The main CPU 501 receives outputs of these sensors.

The main CPU 501 is connected to an erasing device 504 configured to drive the heating roller 107, a recording medium conveying device 505, the conveying motor 207, the discharge motor 205, the clutch 205A, and the conveying roller solenoids 209 configured to drive the displacing mechanism 208 and lift and lower the conveying rollers 206. The main CPU 501 controls operations of these devices.

Figure 6:
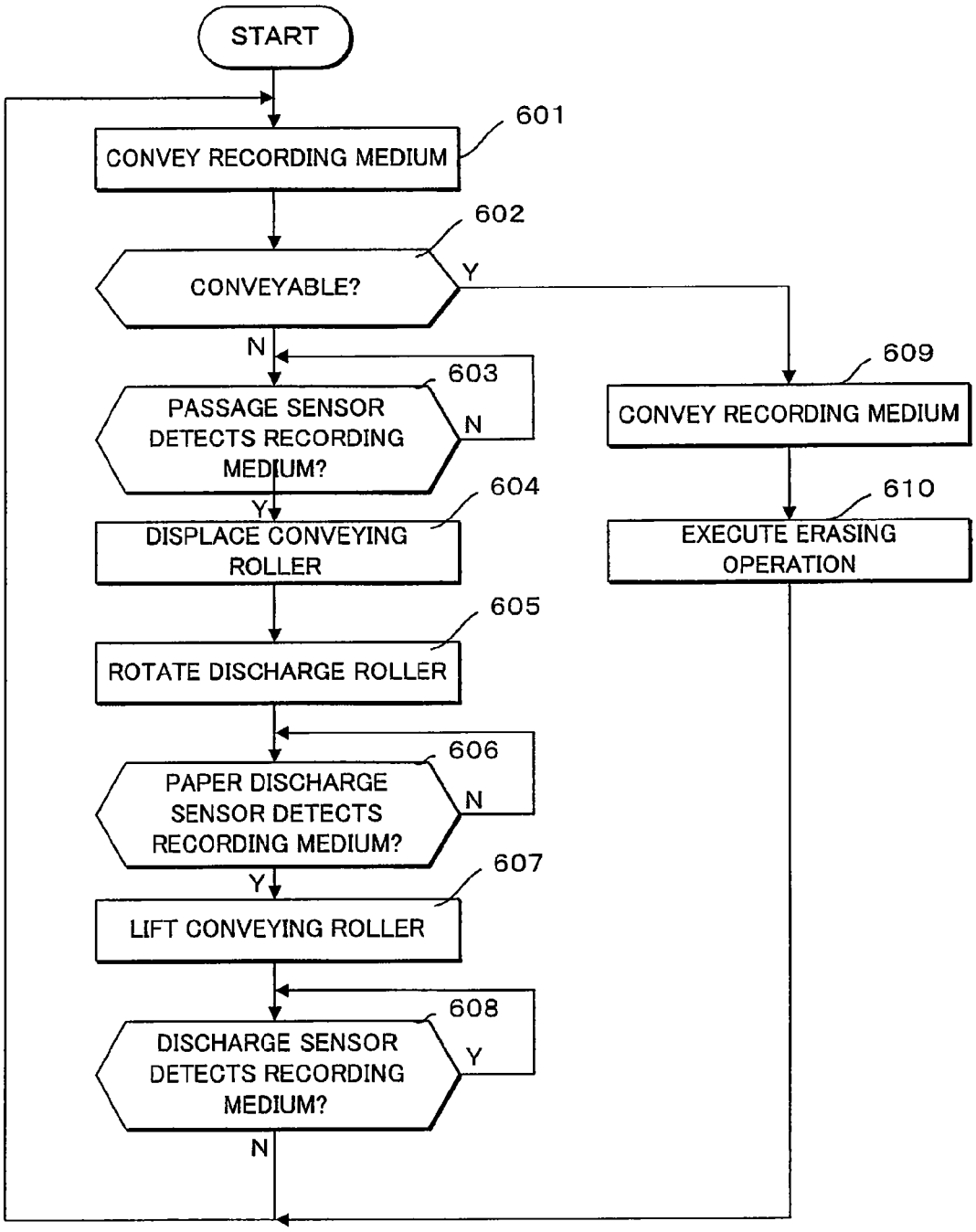
FIG. 6 is a flowchart for explaining the operation of the erasing apparatus according to the first embodiment.

FIG. 6 is a flowchart for explaining the operation of the erasing apparatus 10. As shown in FIG. 6, in Act 601, the erasing apparatus 10 conveys a recording medium and inserts the recording medium into the recording medium removing apparatus 200.

In Act 602, the erasing apparatus 10 determines, on the basis of an output of the thickness sensor 201, whether the recording medium is conveyable. If the erasing apparatus 10 determines that the recording medium is unconveyable, the erasing apparatus 10 proceeds to Act 603. If the erasing apparatus 10 determines that the recording medium is conveyable, the erasing apparatus 10 proceeds to Act 609.

In Act 603, the erasing apparatus 10 determines whether the passage sensors 202 detect the recording medium. If the erasing apparatus 10 determines that the passage sensors 202 detect the recording medium, the erasing apparatus 10 proceeds to Act 604. If the erasing apparatus 10 determines that the passage sensors 202 do not detect the recording medium, the erasing apparatus 10 returns to Act 603.

In Act 604, the erasing apparatus 10 connects the clutch 205A and drives the discharge motor 205 to displace the frame 211 to thereby move the recording medium nipped by the conveying rollers 206 and the lower conveying rollers 206A to the discharge rollers 204 side in the direction perpendicular to the recording medium conveying direction.

In Act 605, the erasing apparatus 10 rotates the discharge rollers 204.

In Act 606, the erasing apparatus 10 determines whether the discharge sensor 203 detects the recording medium. If the erasing apparatus 10 determines that the discharge sensor 203 detects the recording medium, the erasing apparatus 10 proceeds to Act 607. If the erasing apparatus 10 determines that the discharge sensor 203 does not detect the recording medium, the erasing apparatus 10 returns to Act 606.

In Act 607, the erasing apparatus 10 drives the conveying roller solenoids 209 to lift the conveying rollers 206. Therefore, the recording medium passed from the conveying rollers 206 and the lower conveying rollers 206A to the discharge rollers 204 is discharged to the disposal box 111 by the discharge rollers 204.

In Act 608, the erasing apparatus 10 determines whether the discharge sensor 203 detects the recording medium. If the erasing apparatus 10 determines that the discharge sensor 203 detects the recording medium, the erasing apparatus 10 returns to Act 608. If the erasing apparatus 10 determines that the discharge sensor 203 does not detect the recording medium, the erasing apparatus 10 returns to Act 601.

In Act 609, the erasing apparatus 10 conveys the recording medium. In Act 610, the erasing apparatus 10 executes an erasing operation on the recording medium.

As explained above, the erasing apparatus 10 including the recording medium removing apparatus 200 according to this embodiment includes the thickness sensor 201 configured to detect the thickness of the recording medium, the conveying rollers 206 and the lower conveying rollers 206A that are displaced in the direction perpendicular to the recording medium conveying direction while keeping nipping the recording medium, and the discharge rollers 204 provided at a side end in the recording medium conveying direction and configured to remove the recording medium in the direction perpendicular to the recording medium conveying direction.

Therefore, there is an effect that, even if a sheet bundle having thickness exceeding a tolerance of the thickness sensor is conveyed to the erasing apparatus 10, it is possible to remove the sheet bundle.

Second Embodiment

Figure 7:
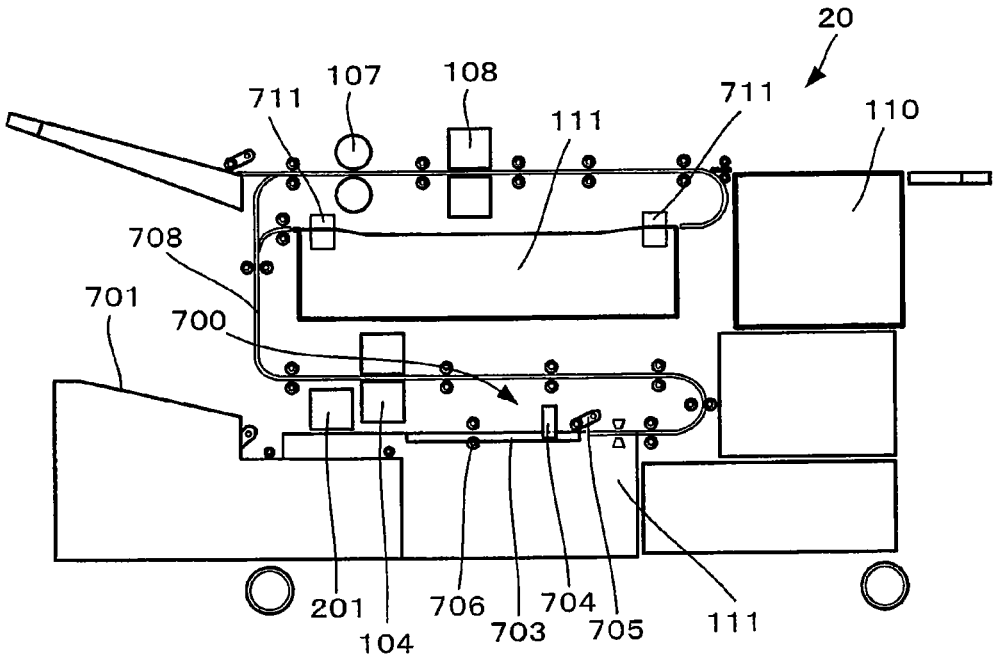
FIG. 7 is a side view of an erasing apparatus including a recording medium removing apparatus according to a second embodiment.
Figure 8:
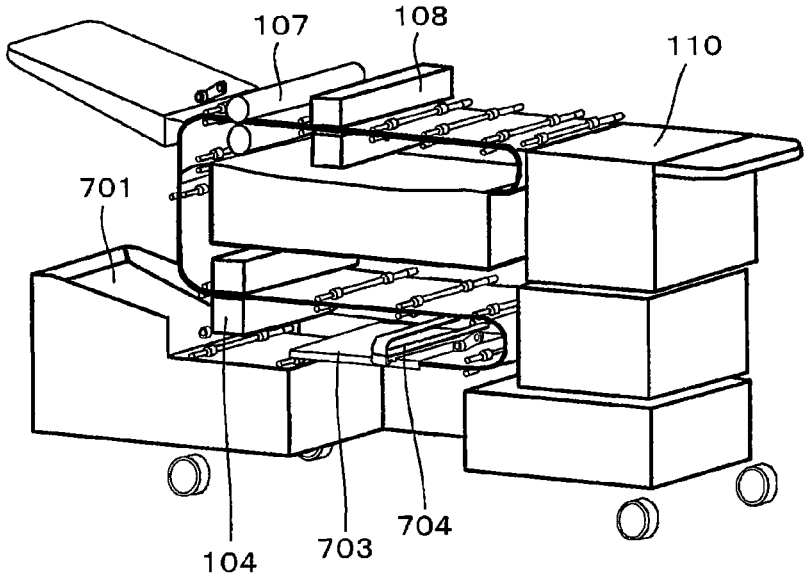
FIG. 8 is a perspective view of the erasing apparatus including the recording medium removing apparatus according to the second embodiment.

FIG. 7 is a side view of an erasing apparatus 20 including a recording medium removing apparatus 700 according to a second embodiment. FIG. 8 is a perspective view of the erasing apparatus 20 including the recording medium removing apparatus 700 according to the second embodiment. As shown in FIG. 7 and FIG. 8, the erasing apparatus 20 includes an inlet tray 701 on which recording media to be subjected to erasing are placed, the thickness sensor 201 configured to detect the thickness of a recording medium, the recording medium removing apparatus 700, a recording medium conveying device 708 configured to convey the recording medium, the heating roller 107 configured to heat the recording medium to temperature equal to or higher than erasing temperature, the reuse box 110 in which reusable recording media are accumulated, the disposal box 111 in which unreusable recording media are accumulated, the double feed sensor 104, the image detection sensor 108, and a control unit.

The erasing apparatus 20 includes the recording medium removing apparatus 700 upstream in a recording medium conveying direction of the heating roller 107.

The recording medium removing apparatus 700 conveys the recording medium determined as unconveyable on the basis of the output of the thickness sensor 201 in a direction perpendicular to the recording medium conveying direction and removes the recording medium from a recording medium conveying path. The control unit determines that the recording medium is unconveyable if the output of the thickness sensor 201 is equal to or larger than the threshold.

The erasing apparatus 20 may include, at a terminal end of the recording medium conveying path leading to the disposal box 111, a shredder mechanism 711 configured to cut a paper-like member.

The recording medium removing apparatus 700 includes a conveyance guide 703 that can be lifted and lowered, a removing belt 704 serving as a recording medium removing mechanism configured to remove the recording medium in the direction perpendicular to the recording medium conveying direction, a pickup roller 705 configured to pick up the recording medium, and conveying rollers 706.

The removing belt 704 is formed by, for example, an endless belt and rotates sideways with respect to the recording medium conveying direction, for example, in the direction perpendicular to the recording medium conveying direction. The recording medium removing apparatus 700 includes the removing belt 704 above the conveyance guide 703.

Figure 9:
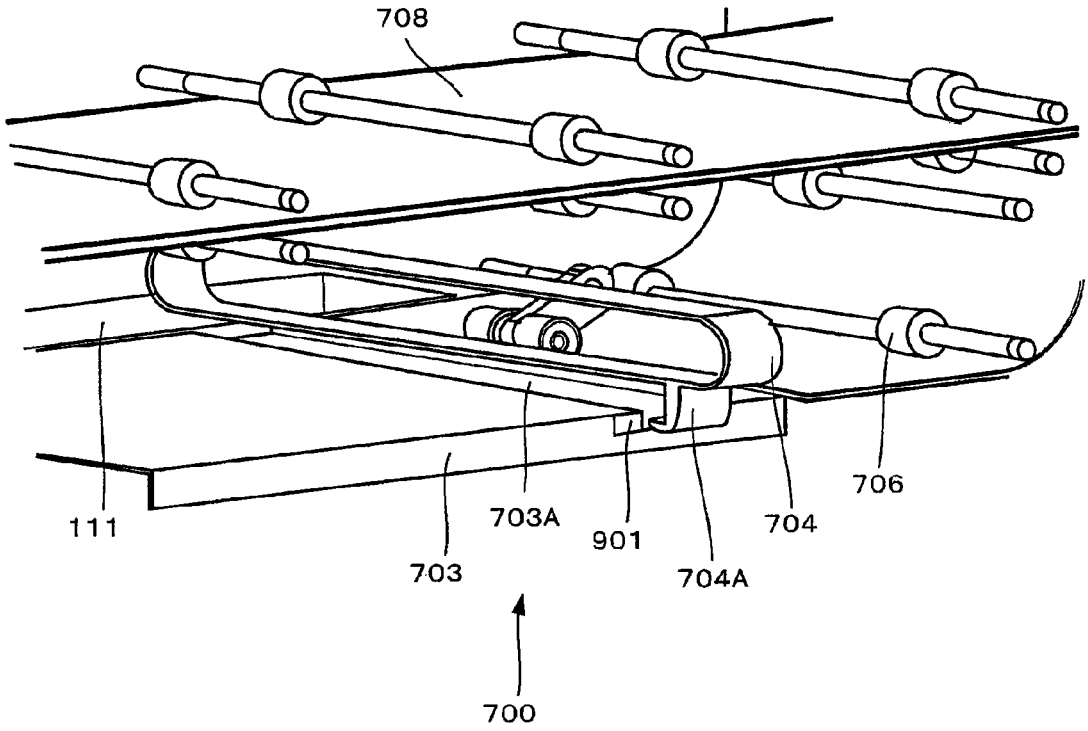
FIG. 9 is an enlarged perspective view of the recording medium removing apparatus according to the second embodiment.

FIG. 9 is an enlarged perspective view of the recording medium removing apparatus 700 according to the second embodiment. As shown in FIG. 9, the recording medium removing apparatus 700 includes, on the removing belt 704, a pawl section 704A configured to hook and convey the recording medium.

The recording medium removing apparatus 700 includes, on the conveyance guide 703, a groove section 703A through which the pawl section 704A passes.

The pawl section 704A has length for allowing a distal end of the pawl section 704A to fit in the groove section 703A when the conveyance guide 703 is lifted. The groove section 703A has depth for preventing the groove section 703A from interfering with the pawl section 704A when the pawl section 704A passes through the groove section 703A.

When the removing belt 704 rotates, the pawl section 704A of the removing belt 704 moves to cross the recording medium conveying path in the direction perpendicular to the recording medium conveying direction. The pawl section 704A removes the recoding medium on the conveyance guide 703 in the direction perpendicular to the recording medium conveying direction.

The recording medium removing apparatus 700 includes, in a setting position of the removing belt 704 of the recording medium conveying device 708, a home position sensor 901 configured to detect whether the pawl section 704A is present in a home position.

Figure 10:
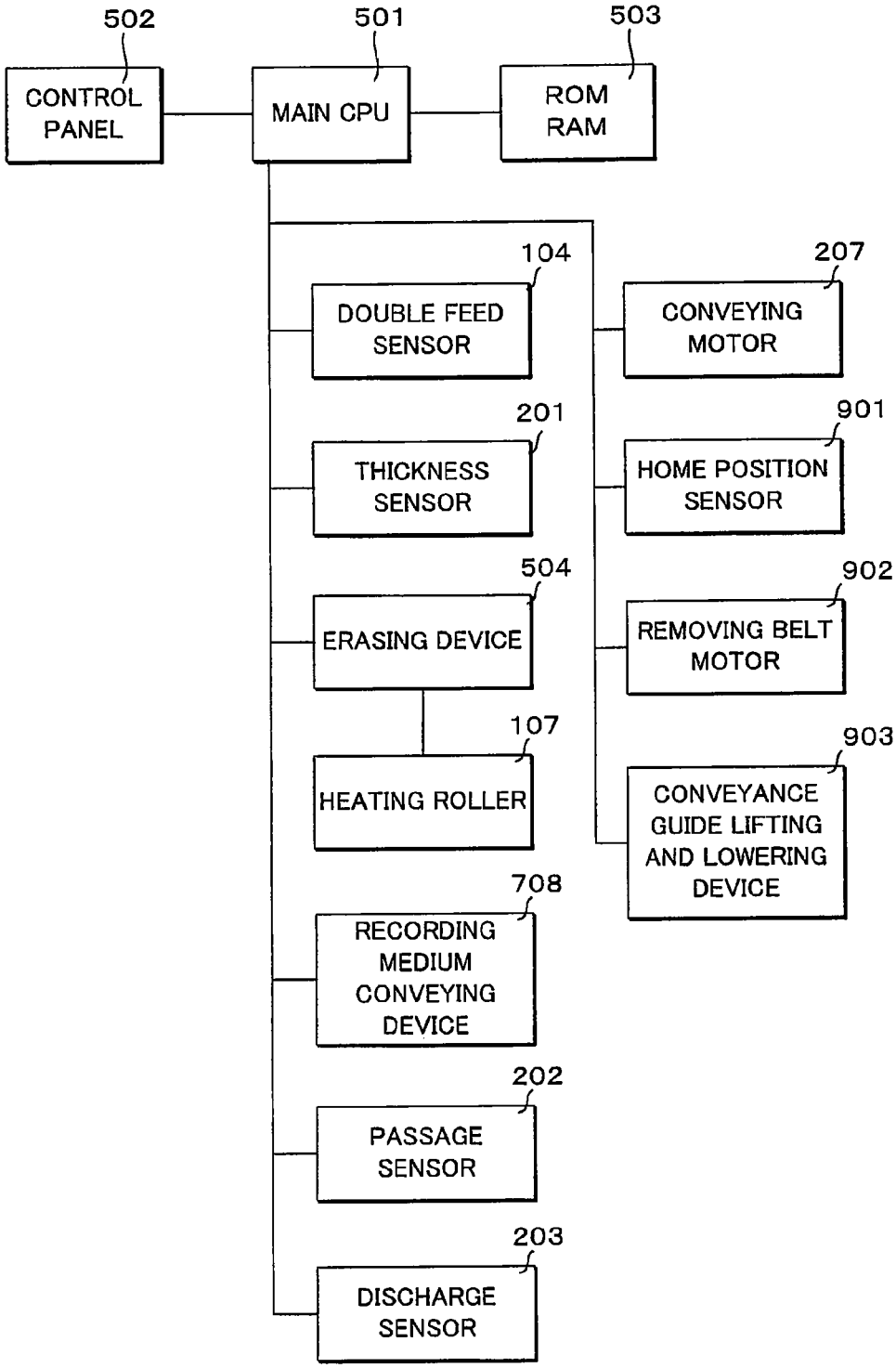
FIG. 10 is a block diagram of the configuration of the erasing apparatus.

FIG. 10 is a block diagram of the configuration of the erasing apparatus 20. As shown in FIG. 10, the erasing apparatus 20 includes the main CPU 501 serving as a control unit, the control panel 502 serving as a display device, and the ROM and RAM 503 serving as a storage device.

The main CPU 501 is connected to the double feed sensor 104, the thickness sensor 201, the passage sensors 202 provided in positions corresponding to the removing belt 704 in the recording medium conveying path of the recording medium removing apparatus 700 and configured to detect that the recording medium reaches a dischargeable position, and the discharge sensor 203, all of which are included in the erasing apparatus 20. The main CPU 501 receives outputs of these sensors.

The main CPU 501 is connected to the erasing device 504 configured to drive the heating roller 107, the recording medium conveying device 708, the conveying motor 207 configured to drive the conveying rollers, a removing belt motor 902 configured to drive the removing belt 704, and a conveyance guide lifting and lowering device 903 configured to lift and lower the conveyance guide 703. The main CPU 501 controls operations of these devices.

Figure 11:
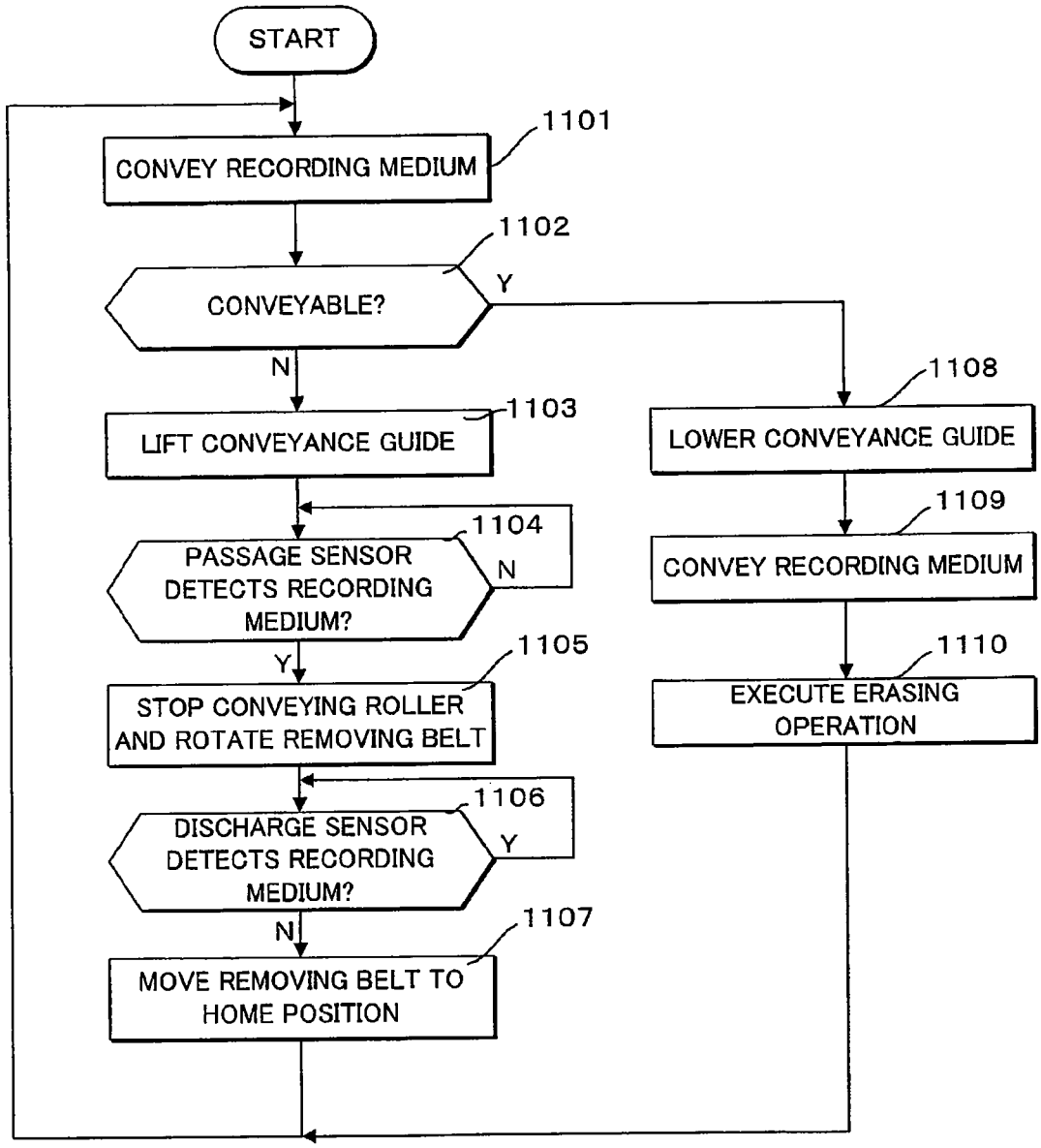
FIG. 11 is a flowchart for explaining the operation of the erasing apparatus.

FIG. 11 is a flowchart for explaining the operation of the erasing apparatus 20. As shown in FIG. 11, in Act 1101, the erasing apparatus 20 conveys a recording medium and inserts the recording medium into the recording medium removing apparatus 700.

In Act 1102, the erasing apparatus 20 determines, on the basis of an output of the thickness sensor 201, whether the recording medium is conveyable. If the erasing apparatus 20 determines that the recording medium is unconveyable, the erasing apparatus 20 proceeds to Act 1103. If the erasing apparatus 20 determines that the recording medium is conveyable, the erasing apparatus 20 proceeds to Act 1108.

In Act 1103, the erasing apparatus 20 lifts the conveyance guide 703.

In Act 1104, the erasing apparatus 20 determines whether the passage sensors 202 detect the recording medium. If the erasing apparatus 20 determines that the passage sensors 202 detect the recording medium, the erasing apparatus 20 proceeds to Act 1105. If the erasing apparatus 20 determines that the passage sensors 202 do not detect the recording medium, the erasing apparatus 20 returns to Act 1104.

In Act 1105, the erasing apparatus 20 stops the conveying rollers 706 and rotates the removing belt 704. Therefore, the recording medium is discharged to the disposal box 111 by the removing belt 704.

In Act 1106, the erasing apparatus 20 determines whether the discharge sensor 203 detects the recording medium. If the erasing apparatus 20 determines that the discharge sensor 203 detects the recording medium, the erasing apparatus 20 proceeds to Act 1107. If the erasing apparatus 20 determines that the discharge sensor 203 does not detect the recording medium, the erasing apparatus 20 returns to Act 1106.

In Act 1107, the erasing apparatus 20 moves the removing belt 704 to the home position.

In Act 1108, the erasing apparatus 20 lowers the conveyance guide 703. In Act 1109, the erasing apparatus 20 conveys the recording medium. In Act 1110, the erasing apparatus 20 executes an erasing operation on the recording medium.

As explained above, the erasing apparatus 20 including the recording medium removing apparatus 700 according to this embodiment includes the thickness sensor 201 configured to detect the thickness of a recording medium, the removing belt 704 configured to remove the recording medium in the direction perpendicular to the recording medium conveying direction, and the conveyance guide 703 that can be lifted and lowered.

Therefore, there is an effect that, even if a thick sheet bundle is conveyed to the erasing apparatus 20, it is possible to remove the sheet bundle.

While certain embodiments have been described, these embodiments have been presented by way of example only, and are not intended to limit the scope of the inventions. Indeed, the novel methods and apparatuses described herein may be embodied in a variety of other forms; furthermore, various omissions, substitutions and changes in the form of the methods and systems described herein may be made without departing from the spirit of the inventions. The accompanying claims and their equivalents are indeed to cover such forms or modifications as would fall within the scope and spirit of the inventions.

What is claimed is:

1. A recording medium removing apparatus comprising:

a thickness sensor configured to change an output signal according to thickness of a recording medium;

a recording medium conveying mechanism configured to convey the recording medium;

a recording medium removing mechanism provided downstream in a recording medium conveying direction of the thickness sensor and configured to remove the recording medium sideways with respect to the recording medium conveying direction; and a control unit configured to remove, if the control unit determines that the recording medium is unconveyable, the recording medium from a recording medium conveying path with the recording medium removing mechanism.

2. The apparatus according to claim 1, wherein the recording medium removing mechanism includes:

a conveying roller and a lower conveying roller configured to be displaced in a direction perpendicular to the recording medium conveying direction while keeping nipping the recording medium; and a discharge roller provided at a side end in the recording medium conveying direction and configured to remove the recording medium in the direction perpendicular to the recording medium conveying direction.

3. The apparatus according to claim 2, wherein, if the control unit determines that the recording medium is unconveyable, the control unit displaces the conveying roller and the lower conveying roller in the direction perpendicular to the recording medium conveying direction while keeping nipping the recording medium and passes the recording medium to the discharge roller, causes the conveying roller and the lower conveying roller to release the recording medium, and causes the discharge roller to remove the recording medium in the direction perpendicular to the recording medium conveying direction.

4. The apparatus according to claim 1, wherein the recording medium removing mechanism includes a removing belt arranged to cross the recording medium conveying path above the recording medium conveying path in a direction perpendicular to the recording medium conveying direction and including a pawl section for removing the recording medium.

5. The apparatus according to claim 4, wherein, if the control unit determines that the recording medium is unconveyable, the control unit stops the conveyance of the recording medium in the recording medium conveying direction and causes the removing belt to remove the recording medium in the direction perpendicular to the recording medium conveying direction.

6. The apparatus according to claim 5, wherein the recording medium removing mechanism includes a conveyance guide having a groove section through which the pawl section passes and set below the removing belt to be capable of being lifted and lowered, and the control unit lifts the conveyance guide before causing the removing belt to remove the recording medium in the direction perpendicular to the recording medium conveying direction.

7. An erasing apparatus comprising:

a thickness sensor configured to change an output signal according to thickness of a recording medium;

a recording medium conveying mechanism configured to convey the recording medium;

a recording medium removing mechanism provided downstream in a recording medium conveying direction of the thickness sensor and configured to remove the recording medium sideways with respect to the recording medium conveying direction;

a control unit configured to remove, if the control unit determines that the recording medium is unconveyable, the recording medium from a recording medium conveying path with the recording medium removing mechanism; and a heating device configured to heat the recording medium to temperature equal to or higher than erasing temperature.

8. The apparatus according to claim 7, wherein the recording medium removing mechanism includes:

a conveying roller and a lower conveying roller configured to be displaced in a direction perpendicular to the recording medium conveying direction while keeping nipping the recording medium; and a discharge roller provided at a side end in the recording medium conveying direction and configured to remove the recording medium in the direction perpendicular to the recording medium conveying direction.

9. The apparatus according to claim 8, wherein, if the control unit determines that the recording medium is unconveyable, the control unit displaces the conveying roller and the lower conveying roller in the direction perpendicular to the recording medium conveying direction while keeping nipping the recording medium and passes the recording medium to the discharge roller, causes the conveying roller and the lower conveying roller to release the recording medium, and causes the discharge roller to remove the recording medium in the direction perpendicular to the recording medium conveying direction.

10. The apparatus according to claim 7, wherein the recording medium removing mechanism includes a removing belt arranged to cross the recording medium conveying path above the recording medium conveying path in a direction perpendicular to the recording medium conveying direction and including a pawl section for removing the recording medium.

11. The apparatus according to claim 10, wherein, if the control unit determines that the recording medium is unconveyable, the control unit stops the conveyance of the recording medium in the recording medium conveying direction and causes the removing belt to remove the recording medium in the direction perpendicular to the recording medium conveying direction.

12. The apparatus according to claim 11, wherein the recording medium removing mechanism includes a conveyance guide having a groove section through which the pawl section passes and set below the removing belt to be capable of being lifted and lowered, and the control unit lifts the conveyance guide before causing the removing belt to remove the recording medium in the direction perpendicular to the recording medium conveying direction.

13. A cutting apparatus that cuts a paper-like member, comprising:

a thickness sensor configured to change an output signal according to thickness of the paper-like member;

a paper-like member conveying mechanism configured to convey the paper-like member;

a paper-like member removing mechanism provided downstream in a paper-like member conveying direction of the thickness sensor and configured to remove the paper-like member sideways with respect to the paper-like member conveying direction;

a control unit configured to remove, if the control unit determines that the paper-like member is unconveyable, the paper-like member from a paper-like member conveying path with the paper-like member removing mechanism; and a shredder mechanism configured to cut the paper-like member.

14. The apparatus according to claim 13, wherein the paper-like member removing mechanism includes:

a conveying roller and a lower conveying roller configured to be displaced in a direction perpendicular to the paper-like member conveying direction while keeping nipping the paper-like member; and a discharge roller provided at a side end in the paper-like member conveying direction and configured to remove the paper-like member in the direction perpendicular to the paper-like member conveying direction.

15. The apparatus according to claim 14, wherein, if the control unit determines that the paper-like member is unconveyable, the control unit displaces the conveying roller and the lower conveying roller in the direction perpendicular to the paper-like member conveying direction while keeping nipping the paper-like member and passes the paper-like member to the discharge roller, causes the conveying roller and the lower conveying roller to release the paper-like member, and causes the discharge roller to remove the paper-like member in the direction perpendicular to the paper-like member conveying direction.

16. The apparatus according to claim 13, wherein the paper-like member removing mechanism includes a removing belt arranged to cross the paper-like member conveying path above the paper-like member conveying path in a direction perpendicular to the paper-like member conveying direction and including a pawl section for removing the paper-like member.

17. The apparatus according to claim 16, wherein, if the control unit determines that the paper-like member is unconveyable, the control unit stops the conveyance of the paper-like member in the paper-like member conveying direction and causes the removing belt to remove the paper-like member in the direction perpendicular to the paper-like member conveying direction.

18. A recording medium removing method for a recording medium removing apparatus including a control unit, the method comprising, if it is determined on the basis of an output of a thickness sensor that a recording medium is unconveyable, removing the recording medium from a recording medium conveying path with a recording medium removing mechanism provided downstream in a recording medium conveying direction of the thickness sensor and configured to remove the recording medium sideways with respect to the recording medium conveying direction.

19. The method according to claim 18, further comprising:

moving the recording medium in a direction perpendicular to the recording medium conveying direction with a conveying roller and a lower conveying roller configured to be displaced in the direction perpendicular to the recording medium conveying direction while keeping nipping the recording medium; and removing the recording medium with a discharge roller provided at a side end in the recording medium conveying direction and configured to remove the recording medium in the direction perpendicular to the recording medium conveying direction.

20. The method according to claim 18, further comprising removing the recording medium with a removing belt arranged to cross the recording medium conveying path above the recording medium conveying path in the direction perpendicular to the recording medium conveying direction and including a pawl section for removing the recording medium.

* * * * *